United States Patent [19]

Brink et al.

[11] Patent Number: 4,715,633

[45] Date of Patent: Dec. 29, 1987

[54] CUP HOLDER

[75] Inventors: Douglas F. Brink; John MacConnell, both of Ft. Collins, Colo.

[73] Assignee: Benchmark Ventures, Ft. Collins, Colo.

[21] Appl. No.: 856,053

[22] Filed: Apr. 25, 1986

Related U.S. Application Data

[63] Continuation-in-part of Ser. No. 727,873, Apr. 26, 1985, abandoned.

[51] Int. Cl.[4] ..... A47J 45/10; B65D 23/10

[52] U.S. Cl. ..... 294/31.2; 229/1.5 H

[58] Field of Search ..... 294/27.1, 31.2, 32, 294/33; 215/100 A; 220/85 H, 94 R, 96; 229/1.5 H; 248/145.6

[56] References Cited

U.S. PATENT DOCUMENTS

| | | | |
|---|---|---|---|
| 674,787 | 5/1901 | Metz | 294/31.2 |
| 933,085 | 9/1909 | Leh et al. | 294/31.2 |
| 1,795,615 | 3/1931 | Parran | 294/31.2 X |
| 2,070,367 | 2/1937 | Mackilbank | 294/33 |
| 2,208,478 | 7/1940 | Simons et al. | 294/33 |
| 2,305,628 | 12/1942 | McKay | 294/33 |
| 2,325,841 | 8/1943 | Faber | 294/31.2 |
| 2,991,907 | 7/1961 | Kinnison | 294/31.2 X |
| 3,353,729 | 11/1967 | Hull | 294/31.2 X |
| 3,592,501 | 7/1971 | Stokes et al. | 220/85 H X |
| 3,794,370 | 2/1974 | Lockhart et al. | 294/31.2 |

*Primary Examiner*—Johnny D. Cherry

*Attorney, Agent, or Firm*—James R. Young

[57] ABSTRACT

A device for holding a disposable cup or the like is disclosed. The device includes a member for gripping the cup about the outer surface thereof, and a mechanism for adjusting the gripping member to conform to the diameter of the cup. A handle is provided along with a mechanism for attaching the handle to the gripping member.

16 Claims, 13 Drawing Figures

CUP HOLDER

CROSS-REFERENCE TO RELATED APPLICATION

This patent application is a continuation-in-part of copending U.S. patent application, Ser. No. 727,873, filed Apr. 26, 1985, now abandoned.

BACKGROUND OF THE INVENTION

1. Field of the Invention

This invention relates to cup holding devices and, more particularly, to handle mechanisms for disposable cups. Specifically, the present invention relates to improved cup holding and lifting devices for disposable cups of varying sizes and shapes.

2. Description of the Prior Art

Devices for holding disposable paper cups and the like have been known for years. These devices are frequently used to provide a place to deposit the paper cup when not being held. A typical example of such a device includes a car cup carrier having a bottom support along with a retaining ring for providing an enclosed member to hold the cup. The bottom support and retaining ring are generally interconnected by a hook arm which is adapted for hooking over the side of a car door or other surface. In this manner, a coffee cup or other disposable drinking cup can be inserted through the ring to the bottom support and left in place while not in use.

Other devices attempting to provide the same function as the carrier described above include specially constructed coffee cups or the like having bottom flanges adapted to attach to a base mounting which is in turn secured directly to the dash of a car, the top of a table or the like. Unfortunately, this arrangement requires specially designed cups as well as mounting brackets which are permanently, or at least semi-permanently, attached to a surface.

While the various devices described above all provide means for holding a cup in place while not being held, none of them function specifically to assist in the holding and use of a disposable cup or the like. However, there are some devices presently on the market which provide for enclosing a disposable cup to keep the contents thereof either cold or hot as is desired. Some of these devices also have handle members in order to assist in lifting and drinking from the enclosed cup. However, these thermal devices tend to be expensive to manufacture and bulky to carry and not adjustable to cup sizes.

It is nonetheless desirable for a number of reasons to have some sort of handle mechanism for attachment to a disposable cup. First of all, the paper material used in constructing many disposable cold drink cups is very flimsy and is readily bent, torn or soaked, and thereby weakened. Direct handling of such cups can cause distinct problems with leaking. Moreover, such cups tend to be very bulky when full. With respect to hot drinks, the cups either transmit the heat through the sides thereof to the hand of the user or are manufactured from a thermal material to prevent such heat transmission. In such latter instances, the cups themselves tend to be expensive and/or easily damaged. A handle mechanism which can be firmly grasped in its entirety without having to touch the cup itself would be highly desirable provided such a mechanism is securely fastened about the cup and is also inexpensive to manufacture, lightweight and easy to assemble.

SUMMARY OF THE INVENTION

Therefore, it is one object of the present invention to provide a device for holding disposable cups and the like.

It is another object of the present invention to provide a portable handle mechanism which can be readily attached to disposable cups and the like.

It is a further object of the present invention to provide a cup holder for disposable cups and the like which is lightweight and inexpensive to manufacture yet provides a large handle which can be readily grasped by a user to increase the ease of using the disposable cup.

It is yet another object of the present invention to provide a handle mechanism for a disposable cup which is securely fastened about, and adjustable to various sizes of, disposable cups.

To achieve the foregoing and other objects and in accordance with the purpose of the present invention, a device is disclosed for holding disposable cups and the like. This device includes a member for gripping the cup about the outer surface thereof, and a mechanism for adjusting the gripping member to conform to the diameter of the cup. A handle is also provided along with several alternative mechanisms for attaching the handle to the gripping member and an engagement mechanism for yieldingly retaining a desired cup holder size.

BRIEF DESCRIPTION OF THE DRAWINGS

The features of the present invention which are believed to be novel are set forth with particularity in the appended claims. The invention, together with further objects and advantages thereof, may best be understood by reference to the following detailed description taken in conjunction with the accompanying drawings and in which:

DETAILED DESCRIPTION OF THE PREFERRED EMBODIMENTS

Figure 1:
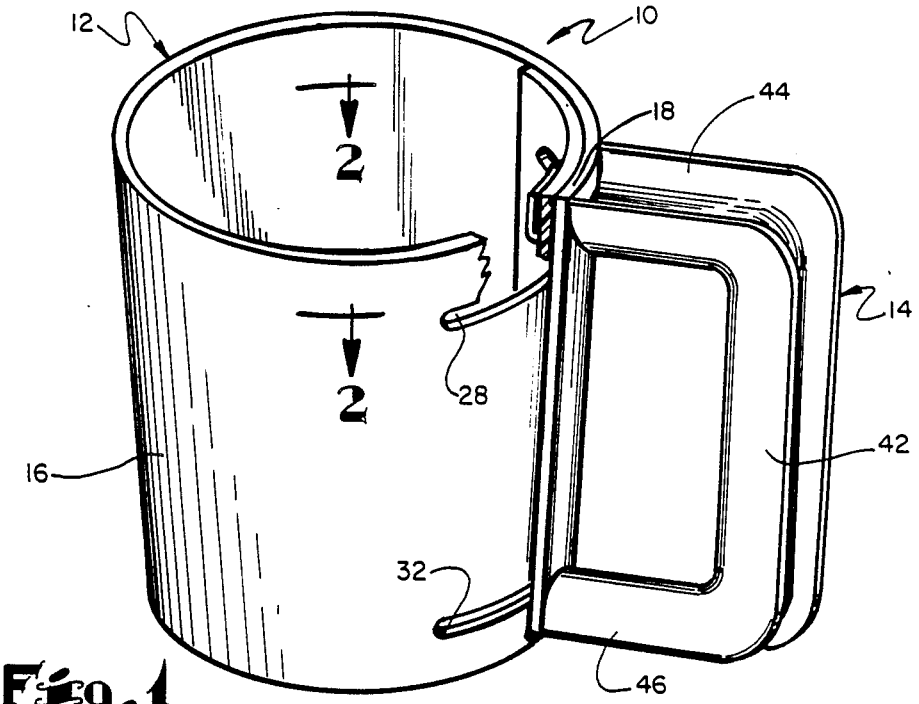
FIG. 1 is a perspective schematic view, with some parts broken away, of a cup holder device constructed in accordance with the present invention.

Referring now to the figures, and more particularly to the schematic illustrated in FIG. 1, a device 10 is provided for holding disposable cups and the like. The cup holder 10 includes a cup gripping member or portion 12 and a handle member or portion 14. The cup gripping portion 12 is adapted to receive and maintain a disposable cup or the like therewithin while a user grasps the handle portion 14 in order to drink from the cup (not illustrated).

Referring more particularly to FIGS. 1–5, the gripping portion 12 preferably includes a resilient unitary member 16 which is coiled in spring-like fashion so that its outer end portion 18 overlaps its inner end portion 20. This relationship can be particularly seen in FIGS. 1 and 2. The resilient gripping member 16 is preferably constructed from a plastic material having a substantial form memory capability such as polypropylene, although polyethylene can also be used. The member 16 is coiled about itself so as to form an inner central opening 22 into which the disposable cup or the like is inserted. As can be seen from FIGS. 1 and 4, the member 16 is preferably in the form of a truncated cone so as to conform, generally, to the typical shape of disposable drinking cups.

Figure 2:
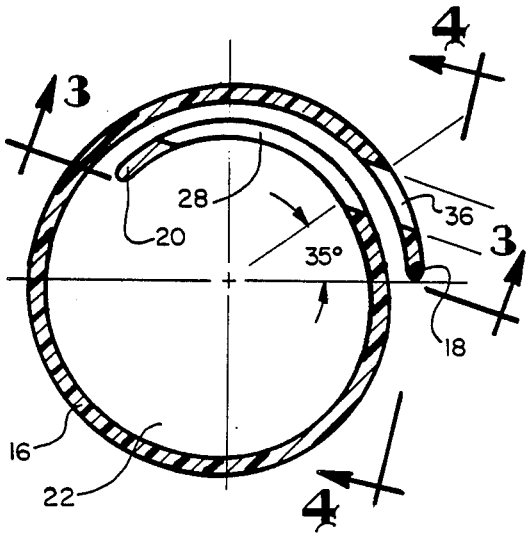
FIG. 2 is a cross-sectional view of the coiled cup gripping portion, of the embodiment illustrated in FIG. 1, taken substantially along line 2—2.
Figure 3:
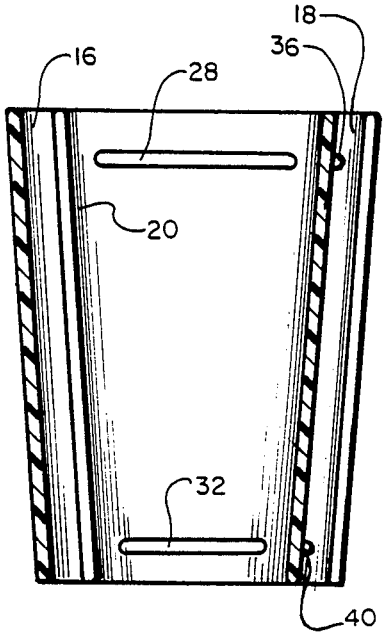
FIG. 3 is a cross-sectional view taken substantially along line 3—3 of FIG. 2 and particularly illustrating the overlapping relationship of the end portions of the gripping member of the present invention.

The member 16 is sufficiently coiled about itself in an unstressed condition, as illustrated in FIG. 2, so that when a disposable cup is inserted into the opening 22, the coiled member 16 is expanded thereby moving the tips of the end portions 18, 20 closer together as illustrated in FIG. 1. This expansion of the coiled member 16 maintains the spring-like member 16 in a stressed condition. It is this stressed condition that causes the member 16 in this embodiment to firmly grip the outer surface of a disposable cup positioned therewithin. Since the end portions 18, 20 can move circumferentially relative to each other, the member 16 is adaptable to receiving a variety of different sized disposable cups therewithin. Once a disposable cup is removed from the opening 22, the memory of the material used to construct the member 16 returns it to its original coiled condition as illustrated in FIG. 2.

Figure 5:
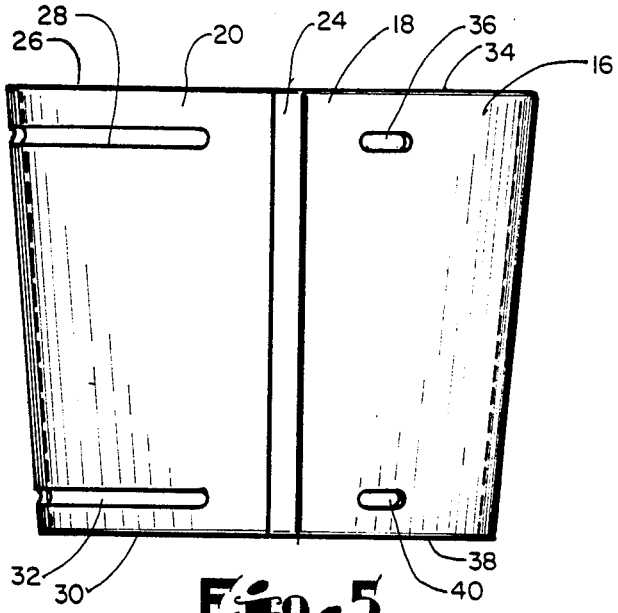
FIG. 5 is a side view of the cup gripping member as illustrated in FIG. 4 except that the gripping member is completely expanded to eliminate the coiled shape and overlapping end portions thereof.
Figure 4:
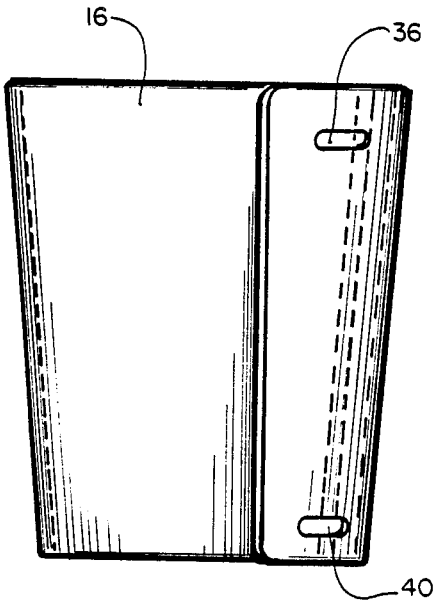
FIG. 4 is a side view of the cup gripping member of the embodiment of the present invention shown in FIG. 2 and taken substantially along line 4—4 of FIG. 2.

FIG. 4 also illustrates the member 16 in its unstressed condition. FIG. 5, on the other hand, illustrates the same gripping member 16 in a state beyond its maximum operational stressed condition. In FIG. 5, the end portions 18, 20 are no longer overlapping and in fact have been separated by a gap 24. It should be noted that the condition illustrated in FIG. 5 is for purposes of illustrating the present invention only and is not a condition achieved during normal use of the invention.

Disposed along the inner end portion 20 near its upper edge 26 is an elongated slot 28. Likewise, disposed proximate the lower edge 30 of the inner end portion 20 is a second elongated slot 32. Due to the truncated shape of the member 16, slot 32 is preferably slightly shorter than slot 28.

In somewhat similar form, an opening 36 is disposed proximate the upper edge 34 of the outer end portion 18. Likewise, disposed proximate the lower edge 38 of the outer end portion 18 is a second opening 40. Openings 36 and 40 are in the form of short slots and are positioned the same distance from the upper and lower edges 34, 38 as the slots 28, 32 are positioned from the upper and lower edges 26, 30 of the inner end portion 20. In this manner, when the outer end portion 18 overlaps the inner end portion 20 as particularly disclosed and illustrated in FIGS. 1 and 2, the openings 36, 40 align with the slots 28, 32. A fastener mechanism, as described in greater detail below, is then used to interconnect the end portions 18, 20 through the aligned openings and slots 36, 28 and 40, 32. In this manner, the end portions 18, 20 are interconnected, yet they may slide circumferentially relative to each other along the length of the slots 28, 32.

This relative movement between the end portions 18, 20 enables the coiled member 16 to automatically adjust to the diameter of a disposable cup placed within the central opening 22. This adjustment is possible so long as the diameter of the cup disposed therewithin is not so great as to attempt to expand the member 16 beyond the full length of the slots 28, 32. However, as will be evident, the resiliency of the material selected for the member 16 as well as the length of the slots 28, 32 enable the member 16 to be constructed in such a fashion as to be adjustable to most standard sizes of cups generally available in the market. In preferred form, as particularly illustrated in FIG. 2, the circumferentially innermost end of the opening 36 is aligned with the circumferentially outermost end of the opening 28 at an angle of approximately 35° relative to a line intersecting the center of opening 22 and the tip of outer end portion 18.

Figure 6:
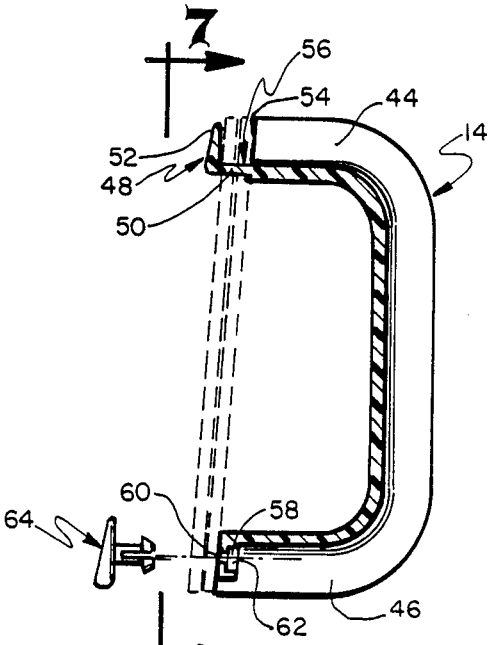
FIG. 6 is a cross-sectional view of the handle portion of the present invention taken substantially along line 6—6 of FIG. 7 and illustrating one embodiment of the attachment means therefor.
Figure 7:
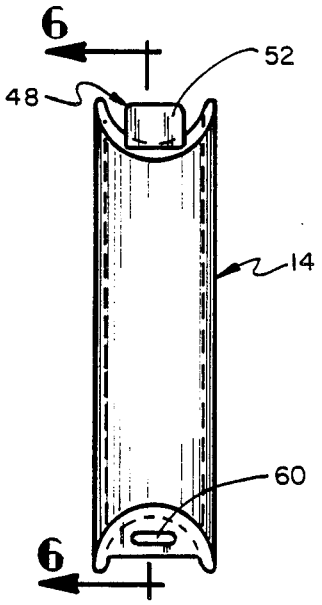
FIG. 7 is an elevation view of the handle of the portion of the present invention taken substantially line 7—7 of FIG. 6.
Figure 8:
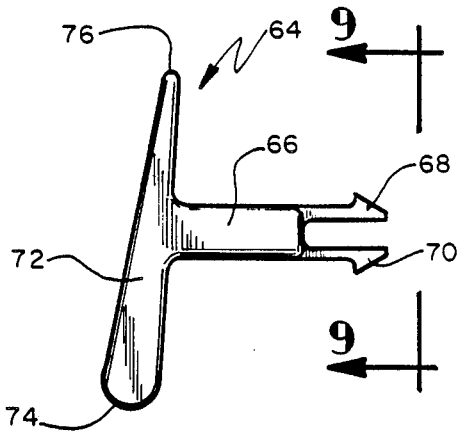
FIG. 8 is an enlarged side view of a connecting tab member utilized to connect the handle and gripping portions of one embodiment of the present invention.
Figure 9:
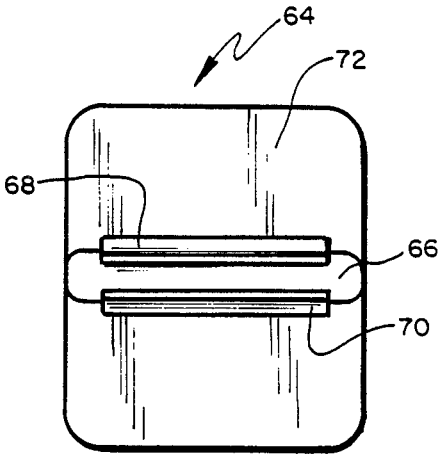
FIG. 9 is a rear view of the enlarged connecting tab member illustrated in FIG. 8 and taken substantially along line 9—9 of FIG. 8.

Referring more particularly, now to FIGS. 1, 6 and 7, the handle portion 14 generally includes a hand grip 42 having two attachment arms 44, 46. The attachment arms 44, 46 may be distinct units from the hand grip 42 or may be merely an integral extension of the hand grip 42. Preferably, the handle portion 14 extends the entire length of the resilient coiled member 16 so as to provide a large gripping surface for ease of handling.

In preferred form, the mechanism utilized to attach the handle portion 14 to the coiled member 16 is the same mechanism utilized to interconnect the outer and inner end portions 18, 20 of the member 16 and to provide the automatic adjustment function thereof. In this preferred embodiment, a flange 48 projects from the end of the upper attachment arm 44 and includes a neck portion 50 and an end lip or base portion 52 at substantially right angles to the neck portion 50. The neck portion 50 is sized and shaped to be able to snugly fit through the opening 36 and extend through the slot 28 so that the end shoulder 54 of the upper attachment arm 44 abuts the outer surface of the outer end portion 18 while the end lip 52 abuts the inner surface of the inner end portion 20. In this manner, a space 56 is defined between the end lip 52 and the shoulder 54 and in which is carried the inner and outer end portions 20, 18 of the coiled member 16. In this manner, the outer end portion 18 is fixed relative to the handle portion 14 by attachment of the neck 50 through the opening 36. However, due to the substantial length of the slot 28 relative to the opening 36, the inner end portion is free to move along the neck 50 the entire length of the slot 28 with the neck portion 50 acting as a stop member at either end of the slot 28.

The flange 48 is inserted through the aperture 36 by first inserting the end lip 52 through the aperture 36 and slot 28 with the handle portion 14 at an orientation approximately 90° to its operational orientation. Once the base portion 52 has been inserted through the slot 28, the handle portion 14 is rotated downwardly relative to the coiled member 16 so as to slide the neck portion 52 through the opening 36 and slot 28. The materials selected for construction of the coiled member 16 and the flange 48 should have a substantial form memory capability as described above.

Once the flange 48 has been fully inserted into the coiled member 16, the lower attachment arm 46 abuts the outer surface of the outer end portion 18. Disposed at the end of the lower attachment arm 46 is a cavity 58 in the form of a T-slot having an opening neck portion 60 and an expanded "T" end 62. The opening 60 is sized and shaped to match substantially with the opening 40 in the outer end portion 18.

Referring now in particular to FIGS. 6–9, a connecting tab 64 is provided having a neck portion 66, spring clips 68, 70 disposed at the end of the neck portion 66, and a head portion 72. The spring clips 68, 70 and the neck portion 66 are inserted from within the interior of the coiled member 16 through the slot 32, the opening 40 and into the opening 60. The length of the neck portion 66 and of the clip member 68, 60 are sized so that when the tab 64 has been fully pressed into the opening 60 so that the head portion 64 firmly abuts the inner surface of the inner end portion 20, the clips 68, 70 are free to expand into the T-slot 62 so as to firmly lock the tab 64 in place. In preferred form, the head 72 of the tab 64 is tapered in thickness from its lower end 74 to its upper end 76, with the upper end 76 being very thin. This is to ensure that when a disposable cup is inserted into the coiled member 16, the bottom edge of the cup does not catch the upper edge of the head portion 72. Thus, the tapered form of the head portion 72 prevents the catching of the disposable cup as well as enhances the sliding movement of the disposable cup through the coiled member 16.

Figure 10:
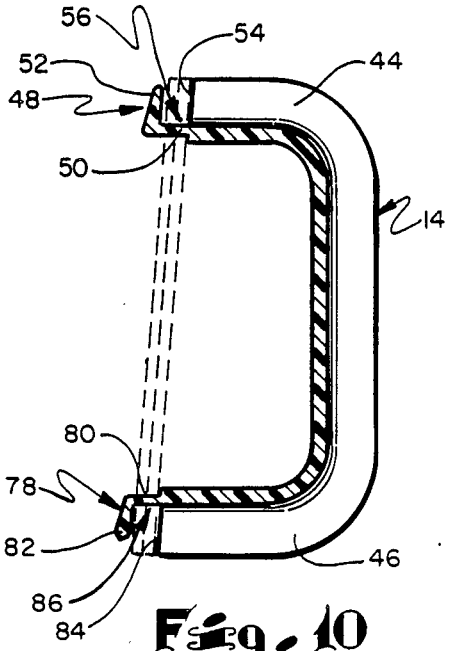
FIG. 10 is cross-sectional view of another embodiment of the handle portion of the present invention.

An alternate embodiment for attaching the handle portion 14 to the coiled member 16 is illustrated in FIG. 10. In this embodiment, the flange 48 is provided at the upper attachment arm 44 of the handle 14 as in the prior embodiment. However, in lieu of the tab 64 of the prior embodiment, a second flange 78 is provided similar to the flange 48. The flange 78 has a neck portion 80 extending from the lower attachment arm 46, and an end lip portion 82 oriented at substantially right angles to the neck portion 80. The flange 78 faces opposite in direction from the flange 48 in that the lip 82 points in a direction opposite from the lip 52. In this manner, the lip 82 and the shoulder 84 of the lower attachment arm 46 define a space 86 in which are contained the inner and outer end portions 20, 18 of the coil 16 in a manner similar to that of the flange 48. In this embodiment, the neck portion 80 projects through the opening 40 and the slot 32, and the end lip portion 82 abuts the inner surface of the inner end portion 20 while the shoulder 84 abuts the outer surface of the outer end portion 18. Preferably, there is also a slight taper to the lip 82 with the narrow end of the taper being adjacent to the neck portion 80 to assist in smooth insertion of a disposable cup into the coil 16. In order for the embodiment illustrated in FIG. 10 to be readily assembled, the flanges 48 and 78 along with handle 14 must be sufficiently flexible and without brittleness to permit appropriate bending of the flanges 48 and 78.

Figure 11:
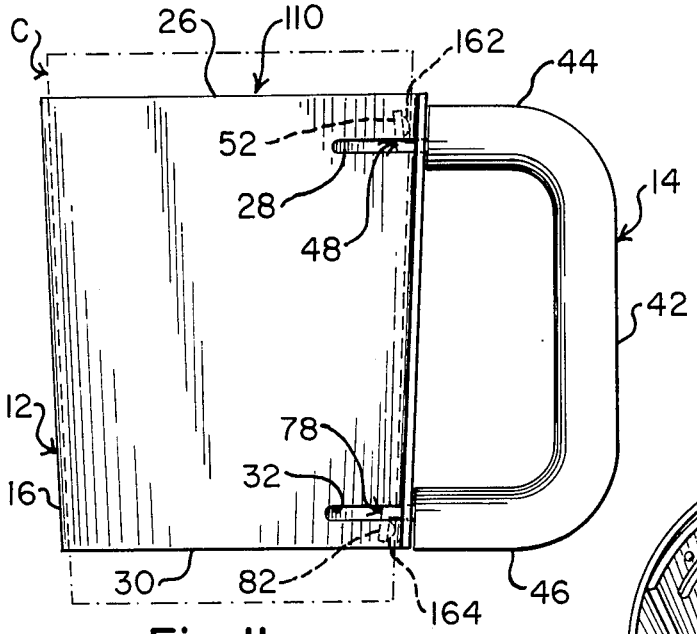
FIG. 11 is a side elevation view of an alternate embodiment of the cup holder having engaging protrusions to retain the selected size of the cup holder.
Figure 12:
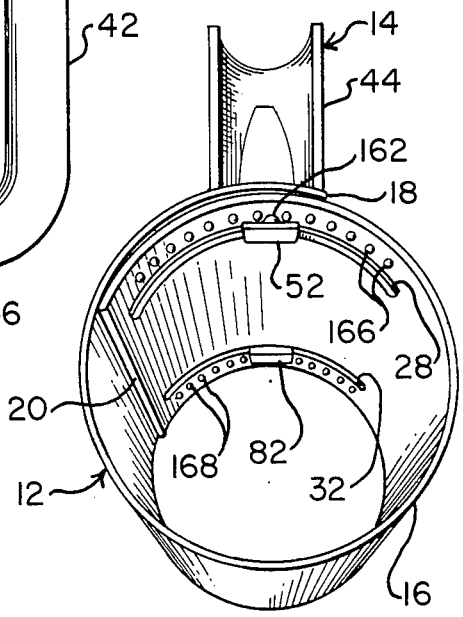
FIG. 12 is a top view in perspective of the alternate embodiment of FIG. 11.
Figure 13:
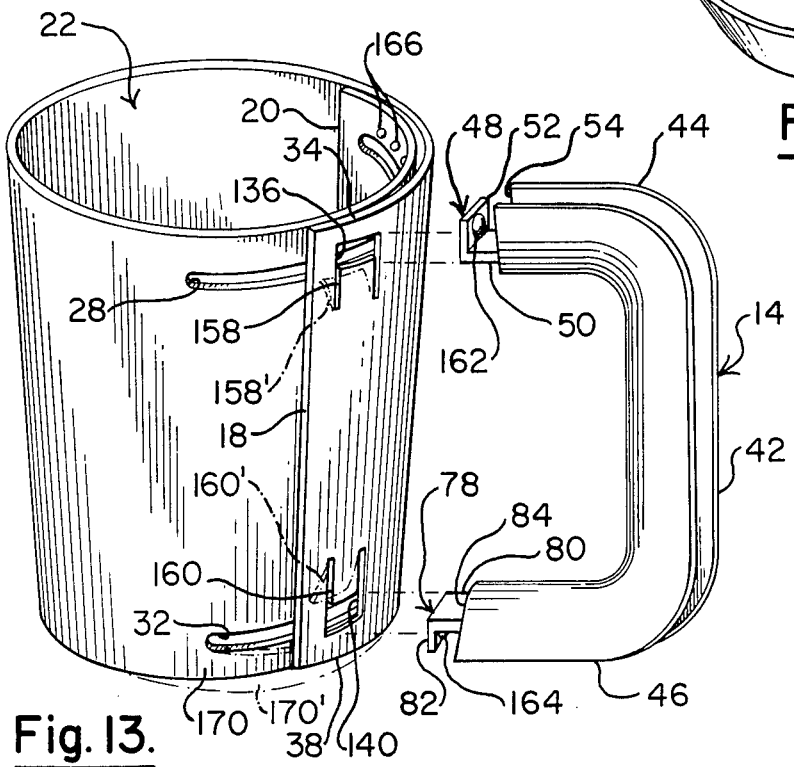
FIG. 13 is a side view in perspective of the alternate embodiment FIG. 11.

As a result of the above, the cup holder of the present invention provides a gripping portion which firmly grips the outer surface of a variety of sizes of disposable cups. This gripping portion automatically adjusts to the diameter of the disposable cup due to the arrangement of the slots 28, 32, the openings 36, 40, the flange 48 and the tab 64 or, in the alternate form, the flange 78. Moreover, a handle 14 which can be easily and firmly grasped by the user of the disposable cup is readily attachable to the gripping member 16. An alternate embodiment of the cup holder 110 according to this invention is shown in FIGS. 11–13. This embodiment is similar to the preferred embodiment described above with a cup gripping portion 12 and handle portion 14. The coiled member 16 is flexible to allow expansion and contraction of the central opening 20 by relative sliding movement between the outer and inner end portions 18, 20; however, a biased resilient memory for automatic size adjustment or gripping of the coiled member 16 on the side of a disposable cup is not necessary.

Instead this cup holder embodiment 110 has engaging protrusions on the inner end portion 20 and on the lips 52, 82 for yieldingly retaining a selected setting or size for the central opening 22. More specifically, a plurality of bead-like protrusions 166 are formed on the inner surface of the inner end member 20 just above the upper slot 28. Also, a plurality of similar bead-like protrusions 168 are formed on the inner surface of the inner end member 20 just below the lower slot 32. Further, knob-like protrusions 162, 164 protrude from respective lip elements 52, 82 in such a manner that they engage the respective bead-like protrusions 166, 168 when the components are assembled.

With the structure, as shown in FIGS. 11–13, the respective outer and inner end portions 18, 20 can be moved slideably in relation to each other any desired amount within the lengths of slots 28, 32 to expand or contract the size of the central opening 22. While the knob-like protrusions 162, 164 on the lip elements 52, 82 do engage the respective bead-like protrusions 166, 168 to inhibit such relative sliding movement, the inner end portion 20 and the components of the flanges 48, 78 have sufficient slight flexibility to yield to forced sliding movement. Therefore, a user can quite readily vary or adjust the size of the cup holder by applying a sufficient amount of force to slide the knobs 162, 164 over the beads 166, 168. Once the desired size is attained, the engagement of the knobs 162, 164 with the beads 166, 168 will retain that selected size.

In this embodiment, as best shown in FIG. 13, the openings 136, 140 are large enough for insertion of the respective flanges 48, 78 therethrough during assembly of the handle portion 14 to the cup gripping portion 12. Semi-rigid tongues 158, 160 protrude partially into respective openings 136, 140 to restrict the size of those openings 136, 140 to about the thickness of the flange necks 50, 80. This feature restricts relative movement between the handle portion 14 and the outer end portion 18 for a tight fit of the assembled components. However, the tongues 158, 160 are sufficiently resilient to bend or yield, as shown in broken lines 158', 160', to forced insertion of the flanges 48, 78 through openings 136, 140 during assembly.

All the components of the present invention as described above may be readily molded from the preferred polypropylene material and may be easily transported and sold in places where disposable cups are frequently encountered, such as in baseball parks, football stadiums and the like. Moreover, the cup holder device of the present invention is readily reuseable for a wide variety of disposable cup sizes due to the memory of its gripping portion. Thus, the present invention provides an economic and simple cup holder arrangement which is readily adaptable and adjustable to a variety of disposable cup sizes and may be easily assembled by the user of the disposable cup. Finally, the present invention provides a large handle grip which increases the ease and comfortability of using flimsy disposable cups and the like.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein but may be modified within the scope of the appended claims.

The embodiments of the invention in which an exclusive property or privilege is claimed are defined as follows:

1. A device for holding a disposable cup or the like, comprising:

a coiled member having two end portions overlapping each other to define a central opening for receiving a cup, one of said end portions being the outer end portion and the other said end portion being the inner end portion with the outer end portion overlapping the inner end portion, the extent of overlap of said end portions being variable for adjustment of the size of said central opening for receiving and gripping various sized cups, said coiled member also having an elongated slot in said inner end portion and an opening in said outer end portion aligned with the slot in the inner end portion;

handle means associated with said coiled member for providing a convenient handle member to hold said coiled member; and combination connecting and attachment means positioned in said slot and in said opening for maintaining said inner and outer end portions in abutting, interconnected relationship while permitting relative sliding movement therebetween throughout the length of said slot to enable expansion and contraction of said coiled member and for attaching said handle means to said coiled member.

2. The device of claim 1, wherein said combination connecting and attachment means comprises a flange having a proximal end projecting from said handle means and extending to a distal end, which flange has a neck portion between said proximal and distal ends positioned through said opening and through said aligned slot and an end lip portion on said distal end of said flange for retaining said inner and outer portions of said coiled member in slidably abutting relation to each other between said handle means and said end lip portion.

3. The device of claim 2, wherein said coiled member has an inherent resiliency that biases said coiled member to a tighter closed position in such a manner that when the coiled member is forced open to enlarge said central opening for insertion of a cup therein, the resiliency of said coiled member creates a self-adjusting, gripping response on the cup.

4. The device of claim 2, including a knob protruding from said end lip portion toward said adjacent inner end portion of said coiled member, and a plurality of beads protruding from said inner end portion toward said end lip portion, said beads being spaced apart in relation to each other and said knob protruding between and engaging selected ones of said beads to inhibit relative sliding movement between said inner end portion and said end lip portion.

5. The device of claim 4, including a resilient tongue protruding partially into said opening, said tongue being sufficiently flexible to yield to forced insertion of said end lip portion through said opening.

6. A reusable handle mechanism for a disposable cup and the like, comprising:

a handle member;

a unitary coiled member having overlapping end portions interconnected for relative sliding movement to permit expansion and contraction of said coiled member in accordance with the diameter of said cup, said coiled member having a first end portion and a second end portion overlapping each other and defining a central opening for receiving said cup, said first end portion including a pair of elongaged slots disposed therein proximate, respectively, the upper and lower edges thereof, said second end portion including a pair of openings likewise disposed proximate the upper and lower edges thereof and aligned with said slots in the first end portion; and attachment means protruding through said aligned openings and slots for securing said handle member to said coiled member and for interconnecting said end portions through said openings and slots.

7. The device of claim 6, wherein the lengths of said elongated slots define the limits of relative movement between said end portions and therefore the amount of expansion available to said coiled member.

8. The device of claim 7, wherein said attachment means comprises a flange disposed on said handle member and projecting outwardly therefrom for insertion through one of said openings and its aligned slot, said flange including an end lip portion for securing said flange within said opening and slot, and a connecting tab insertable through the remaining slot and opening into the other end of said handle member, said connecting tab having a head portion designed to abut the inner surface of the inner end portion of said coiled member to maintain said tab in a secure position.

9. The device of claim 8, wherein said handle member has a first end and a second end and said attachment means comprises a first flange secured to said first end of said handle member and a second flange secured to said second end of said handle member, each said flange having a neck portion insertable through one said opening and slot and an end lip portion for abutment against the inner surface of the inner end portion of said coiled member to secure said flange in position, said flanges and coiled member having sufficient flexibility to permit attachment of said flanges to said coiled member.

10. The device of claim 9, including engagement means on said abutting end lip portion and inner surface of the inner end portion for inhibiting sliding movement of said inner end portion in relation to said end lip portion.

11. The device of claim 10, wherein said engagement means includes a plurality of bead-like protrusions on said inner surface of said inner end portion and a knob-like protrusion on said end lip portion.

12. The device of claim 9, wherein said coiled member is constructed from a material sufficiently resilient to require expansion of said coiled member to receive a cup within said central opening and for said coiled member to grip said cup with sufficient firmness to hold it in said central opening.

13. A cup holder comprising:

a cup mounting member in the form of a flexible coiled sleeve adapted for mounting about the outer surface of said cup, said sleeve having overlapping end portions that are slideable in relation to each other, each of said end portions including openings proximate the upper and lower edges thereof, the openings in one said end portion comprising elongated slots aligned with the openings disposed in the other said end portion;

a handle member having two ends alignable with respective ones of said openings and slots in said end portions; and a first flange projecting from one end of said handle member through one of said openings and through a corresponding aligned slot in said end portions and including a first end lip portion for fastening said first flange firmly to said end portions, and a second flange projecting from the other end of said handle member through the other of said openings and through the other corresponding aligned slot in said end portions, and including a second end lip portion for fastening said second flange firmly to said end portions.

14. The cup holder of claim 13, wherein said second flange includes a tab having a head portion on one end defining said second end lip portion and a fastener on the other end, and wherein said second end of said handle member has a socket for receiving and retaining the fastener end of said tab.

15. The cup holder of claim 13, including engagement means on said abutting inner end portion and on said first end lip portion for yieldingly inhibiting relative sliding movement between said inner end portion and said first end lip portion and on said abutting inner end portion and on said second end lip portion for yieldingly inhibiting relative sliding movement between said inner end portion and said second end lip portion.

16. The cup holder of claim 15, wherein said engagement means includes a plurality of bead-like protrusions on said inner end portion protruding toward said first end lip portion and toward said second end lip portion, and a knob-like protrusion on each of said end lip portions protruding toward said inner end portion.

* * * * *